US007434276B2

(12) United States Patent
Cheng

(10) Patent No.: US 7,434,276 B2
(45) Date of Patent: Oct. 14, 2008

(54) PORTABLE TOILET AND BATHING CHAIR

(75) Inventor: Yu-Wen Cheng, Taichung (TW)

(73) Assignee: Eagle Health Supplies Inc., Orange, CA (US)

( * ) Notice: Subject to any disclaimer, the term of this patent is extended or adjusted under 35 U.S.C. 154(b) by 300 days.

(21) Appl. No.: 11/473,921

(22) Filed: Jun. 23, 2006

(65) Prior Publication Data

US 2007/0294816 A1 Dec. 27, 2007

(51) Int. Cl.
*A47K 11/02* (2006.01)

(52) U.S. Cl. ..... 4/460; 4/483; 297/17; 297/440.15

(58) Field of Classification Search ..... 4/449, 4/460, 476–479, 485–486; 297/17, 230.14, 297/350, 353, 354, 13, 357, 440.15, 440.16
See application file for complete search history.

(56) References Cited

U.S. PATENT DOCUMENTS 1,419,947 A * 6/1922 Schouten ..... 297/17
2,573,104 A * 10/1951 La Baw ..... 297/378.1
4,633,536 A * 1/1987 Tribble-DuBose ..... 4/460
6,189,973 B1 * 2/2001 Wu ..... 297/378.1

* cited by examiner

*Primary Examiner*—Charles E Phillips
(74) *Attorney, Agent, or Firm*—Pro-Techtor Int'l Services

(57) ABSTRACT

A portable toilet and bathing chair comprises a seat of rectangular shape, having a central opening, handles on left and right edges, two positioning openings on an upper side close to a rear edge, two storing depressions in a lower side parallel to and close to the left and right edges, at least three projections on the lower side, and four fastening assemblies on the lower side close to four corners, a backrest of rectangular shape, movable to a folded state close to the lower side of the seat, having positioning holes which are in the folded state entered by the projections of the seat and a lower edge with two holding extensions that are inserted into the positioning openings of the seat, and four feet, in a mounted state mounted on the seat at the lower side thereof close to the four corners thereof and being removable therefrom, wherein for folding, the four feet are removed from the seat and stored in the storing depressions, and the backrest is brought into the folded state thereof.

3 Claims, 3 Drawing Sheets

PORTABLE TOILET AND BATHING CHAIR

BACKGROUND OF THE INVENTION

1. Field of the Invention

The present invention relates to a portable toilet and bathing chair, particularly to a portable toilet and bathing chair which allows to reduce handling costs.

2. Description of Related Art

To assist handicapped or old persons in relieving themselves or bathing, toilet and bathing chairs have appeared on the market.

However, conventional toilet and bathing chairs are voluminous, taking space in bathrooms that is not usable for other purposes anymore. Moreover, conventional toilet and bathing chairs are inconvenient to carry to other locations.

For this reason, foldable toilet and bathing chairs have been made available. As shown in FIG. 6, such a foldable toilet and bathing chair is easily carried in a bag 9.

After usage, however, such a toilet and bathing chair is generally wet and cannot be packed. On the other hand, when not packed, there is a risk of structural parts getting lost.

SUMMARY OF THE INVENTION

An object of the present invention is to provide a portable toilet and bathing chair which is easily carried.

Another object of the present invention is to provide a portable toilet and bathing chair which is easily stored, reducing handling costs.

A further object of the present invention is to provide a portable toilet and bathing chair which saves costs of packing and reduces environmental costs.

For achieving above objects, the present invention has a seat, a backrest and legs which are all foldable to reduce volume, as well as a handle for convenient carrying.

The present invention can be more fully understood by reference to the following description and accompanying drawings.

DETAILED DESCRIPTION OF THE PREFERRED EMBODIMENT

As shown in FIGS. 1-5, the portable toilet and bathing chair of the present invention comprises: a seat 1 on which a user is seated; a backrest 2, fastened to a rear edge of the seat 1; and four feet 3, fastened to four corners of the seat 1 and extending downward therefrom. The seat 1, the backrest 2 and the four feet 3 are foldable into the shape of a plate, so that carrying and storing the chair of the present invention is easy. Furthermore, the seat 1, the backrest 2 and the four feet 3 are fastened together, so that packing material is reduced and handling and environmental cost is reduced.

The seat 1 is shaped like a rectangular plate, having a central opening 10 and handles 13 on left and right edges for convenient handling. Two positioning openings 15 are inserted from above into the seat 1 close to the rear edge thereof. Two storing depressions 14 on a lower side of the seat 1 parallel to and close to the left and right edges thereof accommodate the legs 3 when folded. At least three projections 17 are attached to the lower side of the seat 1 between a front edge thereof and the central opening 10. Four fastening assemblies 12 are attached to the lower side of the seat 1 at the four corners thereof, respectively.

The backrest 2 is shaped like a rectangular plate, having a lower edge, from which two holding extensions 20 extend downward which allow to mount the backrest 2 on the two positioning openings 15 of the seat 1, with the backrest 2 being foldable against the seat 1. Furthermore, the backrest 2 is provided with three positioning holes 22 in positions, such that the three projections 17 respectively slide into the three positioning holes 22 when the backrest 2 is folded against the seat 1 at the lower side thereof.

Furthermore, when folded against the seat 1, the backrest 2 will not laterally extend beyond the seat 1, so that a compact shape is achieved.

The feet 3 are fastened to the four fastening assemblies 12 and removable therefrom.

As shown in FIG. 2, ridges 16 protrude within each of the two positioning openings 15. The two holding extensions 20 have far ends with holding grooves 21 which fit on the ridges 16 and fix the backrest 2 on the seat 1.

Referring to FIG. 3, each of the four fastening assemblies 12 is shaped like a tube, having a lateral hole 121 and a fastening element 123. The fastening element 123 comprises a C-shaped spring 127 inside each of the fastening assemblies 12 and a bolt 125. The bolt 125 has an inner end leaning on a free end of the C-shaped spring 127 and an outer end that extends through the lateral hole 121. Each of the four legs 3 has a lateral end hole 30 which is put over the outer end of the bolt 125 of one of the four fastening assemblies 12, so as to be mounted.

Referring to FIGS. 4 and 5, for folding the chair of the present invention, the legs 3 are removed and stored into the storing depressions 14, then the backrest 2 is folded downward, such that the three projections 17 respectively enter the three positioning holes 22. Thereby the seat 1, the backrest 2 and the four feet 3 are foldable into the shape of a plate, so that carrying and storing the chair of the present invention is convenient, packing material is reduced and handling and environmental cost is reduced.

Figure 1:
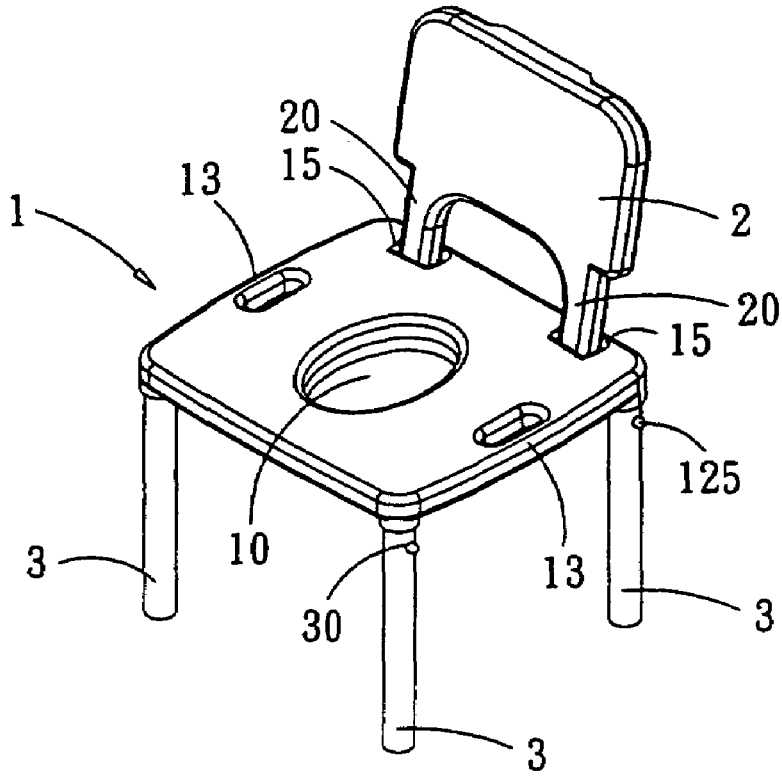
FIG. 1 is a perspective view of the portable toilet and bathing chair of the present invention.
Figure 2:
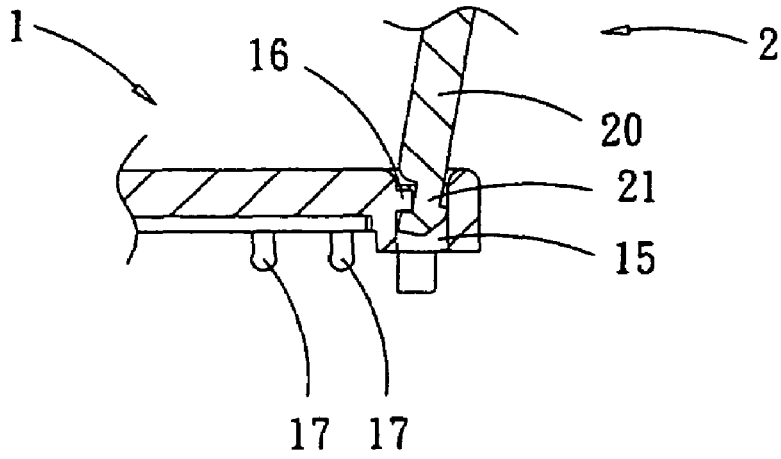
FIG. 2 is a sectional side view of the holding grooves and ridges of the present invention.
Figure 3:
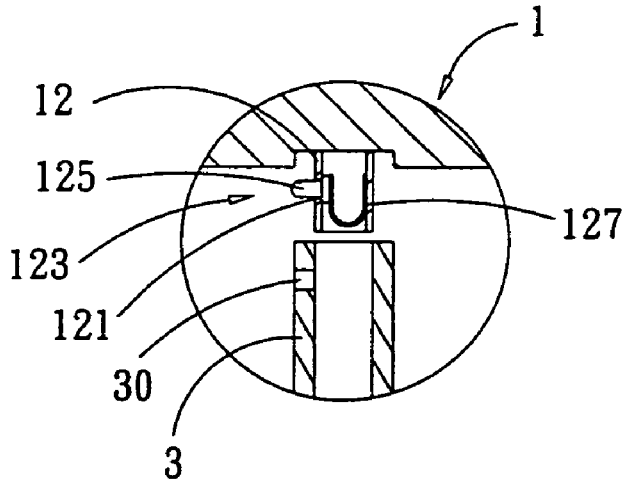
FIG. 3 is an enlarged sectional side view of one of the fastening assemblies of the present invention.
Figure 4:
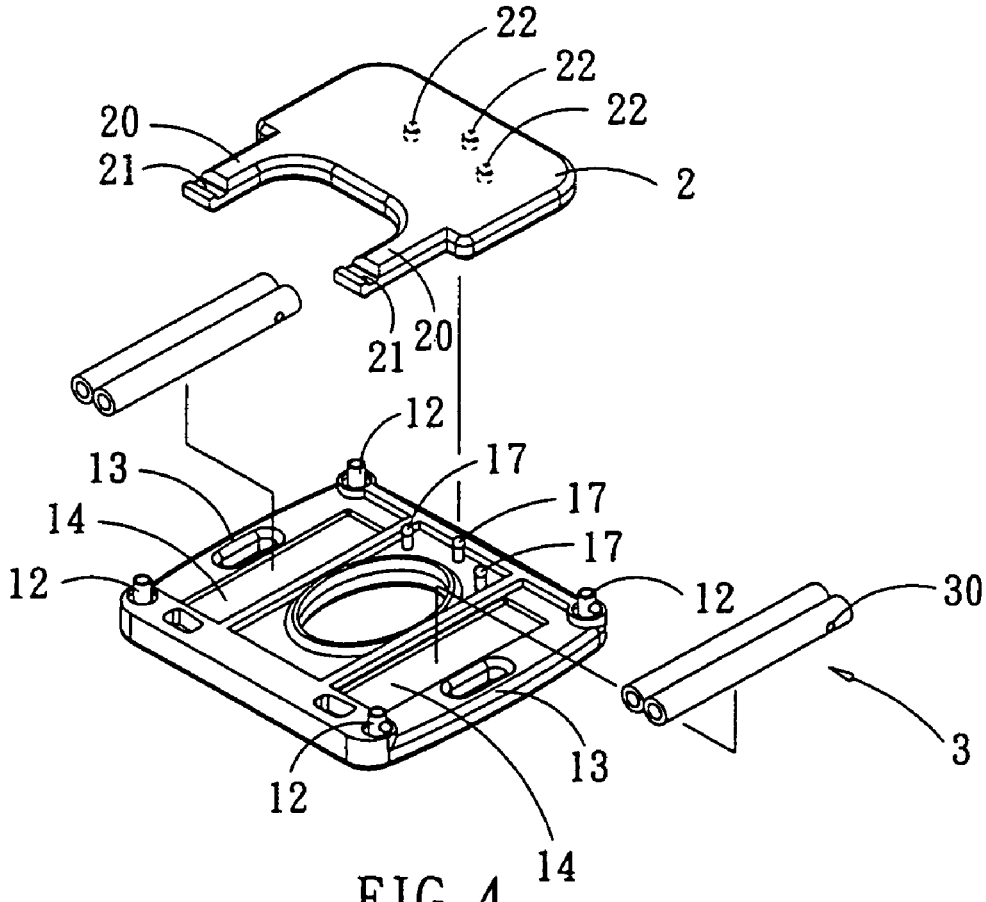
FIG. 4 is a schematic illustration of folding the present invention.
Figure 5:
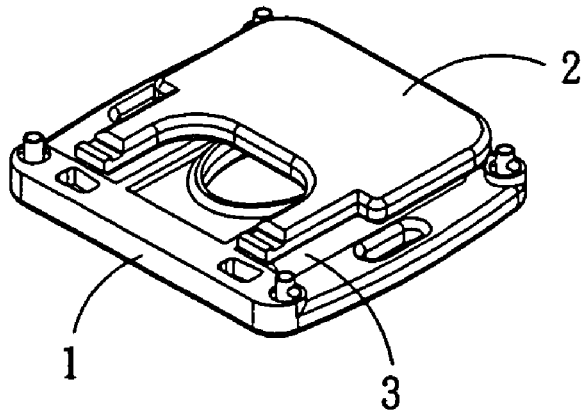
FIG. 5 is a perspective view of the present invention when folded.
Figure 6:
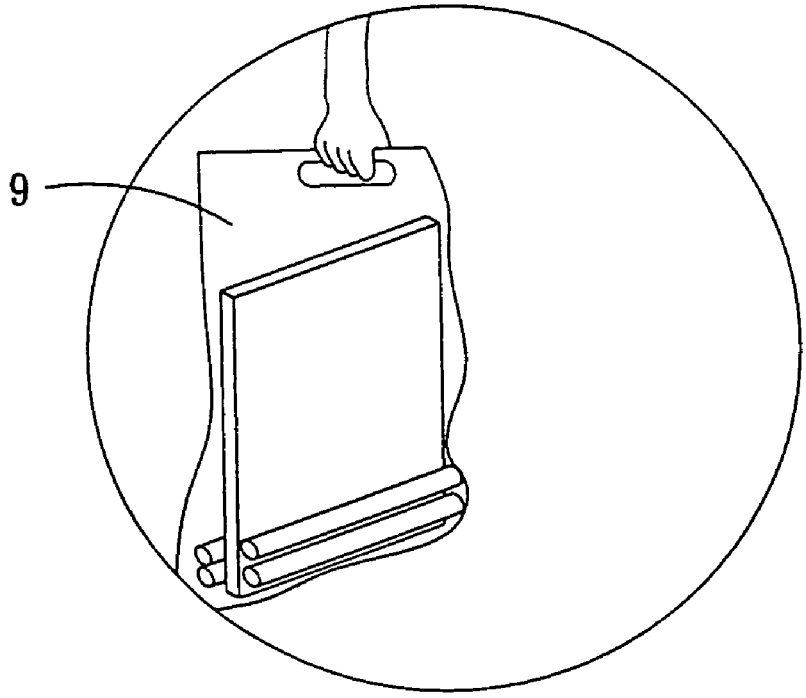
FIG 6(PRIOR ART)
FIG. 6 (prior art) is a perspective view of a conventional toilet and bathing chair when folded.

The invention claimed is:

1. A portable toilet and bathing chair, comprising:

a seat of rectangular shape, having a central opening, handles on left and right edges, two positioning openings on an upper side close to a rear edge, two storing depressions in a lower side parallel to and close to said left and right edges, at least three projections on said lower side, and four fastening assemblies on said lower side close to four corners;

a backrest of rectangular shape, movable to a folded state close to said lower side of said seat, having positioning holes which are in said folded state entered by said projections of said seat and a lower edge with two holding extensions that are inserted into said positioning openings of said seat; and four feet, in a mounted state mounted on said seat at said lower side thereof close to said four corners thereof and being removable therefrom;

wherein for folding, said four feet are removed from said seat and stored in said storing depressions, and said backrest is brought into said folded state thereof.

2. The portable toilet and bathing chair according to claim 1, wherein ridges are placed in said positioning openings and corresponding holding grooves are cut into far ends of said holding extensions.

3. The portable toilet and bathing chair according to claim 1, wherein each of said four fastening assemblies is shaped like a tube having a lateral hole and a fastening element comprising an inner C-shaped spring and a bolt with an inner end that leans against a free end of said C-shaped spring and an outer end that passes through said lateral hole, and wherein each of said four feet has a lateral end hole that in said mounted state is passed through by said bolt of one of said four fastening assemblies.

* * * * *